US005135421A

United States Patent [19]

Morris

[11] Patent Number: 5,135,421

[45] Date of Patent: Aug. 4, 1992

[54] EXPANDABLE BANK

[76] Inventor: Hugh F. Morris, 1730 Stenton Ave., Philadelphia, Pa. 19141

[21] Appl. No.: 384,255

[22] Filed: Jul. 21, 1989

[51] Int. Cl.[5] ..... A45C 1/12; A63H 3/36

[52] U.S. Cl. ..... 446/8; 446/320; 446/901

[58] Field of Search ..... 446/8, 9, 10, 72, 73, 446/74, 79, 487, 901; 232/1 D; D99/38, 40

[56] References Cited

U.S. PATENT DOCUMENTS

| | | | |
|---|---|---|---|
| 87,006 | 2/1869 | Serrell | 446/8 |
| 2,304,415 | 12/1942 | Lawson, Sr. | 446/9 |
| 2,436,604 | 2/1948 | Roberts | 446/8 X |
| 2,448,807 | 9/1948 | Kimball | 446/8 |
| 2,490,275 | 12/1949 | Lepper | 446/8 |
| 2,768,472 | 10/1956 | Whalen | 446/8 |
| 2,779,128 | 1/1957 | West | 446/8 |
| 4,103,455 | 8/1978 | Silvey | 446/73 |
| 4,401,259 | 8/1983 | Knutson | 446/8 |
| 4,593,817 | 6/1986 | Ferrero | 446/8 X |

FOREIGN PATENT DOCUMENTS

| | | | |
|---|---|---|---|
| 407176 | 3/1934 | United Kingdom | 446/73 |

*Primary Examiner*—Mickey Yu

*Attorney, Agent, or Firm*—Eckert Seamans Cherin & Mellott

[57] ABSTRACT

An expandable bank is disclosed which includes a rigid metallic, ceramic or plastic body which is provided with a plurality of support legs, an upper coin slot and a bottom opening. A flexible material pouch or expander is removably affixed over the bottom opening to define an interior, expandable coin receiving compartment. As coins are introduced into the bank through the upper coin slot, the coins fall on the flexible material pouch and the weight of the coins causes the pouch to expand, thereby giving visual evidence of the approximate number of coins contained within the bank. The flexible material pouch is secured about the bottom opening with a reusable fastener. The bank can be repeatedly filled and emptied by first applying the flexible material pouch to the rigid body then filling the bank with coins, separating the fastener to remove the coins and then reapplying the flexible material pouch by using the fastener.

10 Claims, 2 Drawing Sheets

FIG. 3
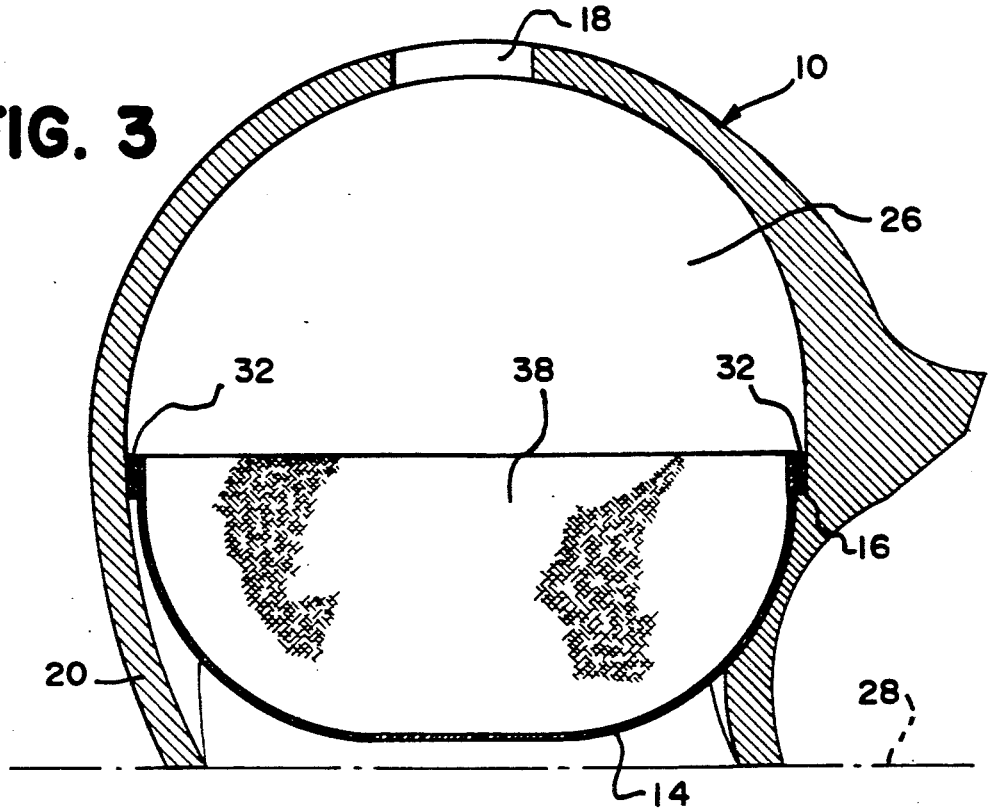
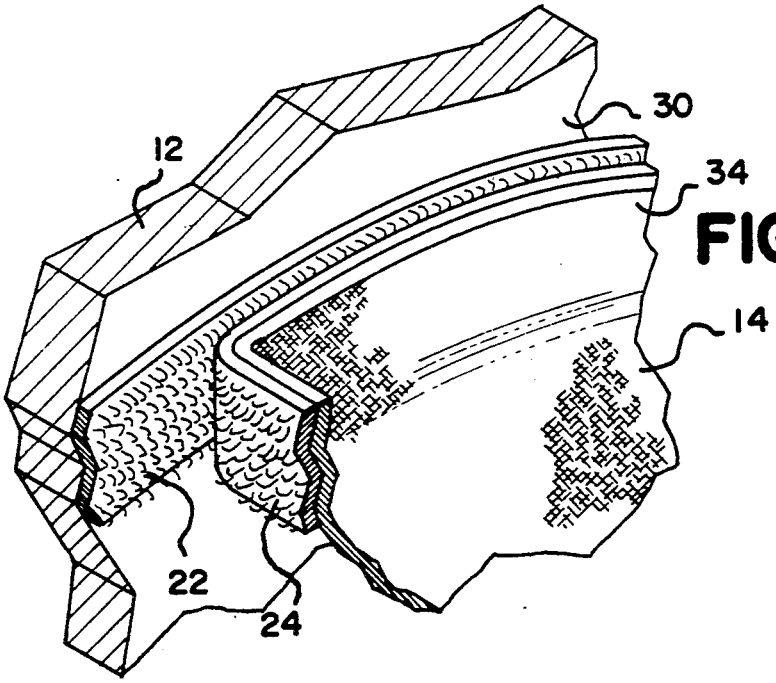
FIG. 5
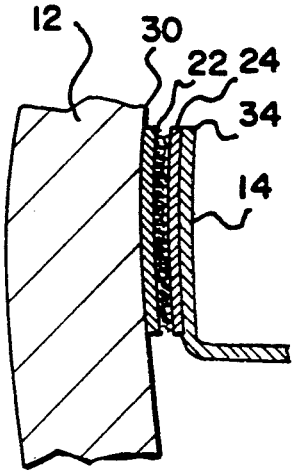
FIG. 4

EXPANDABLE BANK

BACKGROUND OF THE INVENTION

1. Field of the Invention

The present invention relates generally to the field of toy banks, and more particularly, is directed to a toy bank featuring a flexible member which is capable of expanding in response to the insertion of a plurality of coins within the bank.

2. Discussion of the Prior Art

Small coin receiving banks have long been popular both in this country and in many foreign countries and such small, portable banks have been and are still being popularly used both by children and adults for storing and saving a multitude of coins.

Most prior art types of coin banks are constructed of rigid materials, usually metal, in order to provide a degree of security. Additionally, banks fabricated of other hard materials such as ceramics, glass, earthenware and the like have been manufactured. The previously designed and used banks are generally rugged in construction and are designed to include a coin receiving body or enclosure and are provided with an upper coin slot to receive coins therethrough. Most of the prior art designs have also included some type of lockable feature which permits access to the contents of the bank after it has been filled and it is desired to open the bank to retrieve the coins. In those instances wherein a locked door or other arrangement is not provided, it is then necessary to actually smash or otherwise break the bank in order to gain access to the interior contents. The popular glass and ceramic "piggy" banks are characteristic of this type of bank whereby once the bank is filled, it must then be destroyed in order to gain access to the stored coins.

While most prior art banks are rigid in construction in order to securely contain the coins therewithin, it is known that flexible materials have also been employed by prior workers in the art for bank construction purposes. For example, in U.S. Pat. No. 4,718,738, a flexible bank for coins has been disclosed which includes generally a flexible bag having a sidewall portion, a base or bottom portion and an upper edge. When only a few coins are placed in the bag, the bank will not stand upright. After more coins are added, the bag sidewalls will flex and the base portion will then be sufficiently expanded to support the bank in an upright position. This bank is formed of flexible plastic material having its seams closed by heat sealing. When it is desired to open the flexible bank, a knife or similar implement must be employed to actually cut through the bank sidewall construction, thereby rendering the device a single service bank that is incapable of reuse.

In U.S. Pat. No. 2,768,472, there is disclosed a toy bank in the configuration of an animal or bird wherein each design comprises a molded rubber body portion having affixed thereto a thin sheet rubber membrane. The membrane is designed and intended to expand upon the entrance of a sufficient number of coins into the bank interior to thereby assume an expanded configuration to visually indicate the approximate number of coins contained within the bank.

In U.S. Pat. No. 2,779,128, a coin piggy bank has been disclosed wherein the entire hollow body is fabricated from a flexible plastic material which is capable of ready deformation. When the weight of the coins which are inserted into the piggy bank becomes too great, the rearward and forward legs of the bank configuration will collapse, thereby alerting the owner of the fact that the bank has become full. A discharge opening is provided in the bottom of the coin bank whereby the coins can be removed by unthreading the closing plug to thereby gain access to the bank interior.

None of the prior art expandable bank devices, so far as is known to the present applicant, teach or disclose any type of construction feature which enables the user to gain access to the bank interior directly at or about the flexible construction members and then to reassemble and repeatly use the bank.

SUMMARY OF THE INVENTION

The present invention relates generally to the field of coin banks, and more particularly, is directed to a coin bank comprising both rigid and non-rigid members releasably joined together whereby the entrance of coins into the bank causes the non-rigid member to expand to indicate the approximate number or quantity of coins contained within the bank.

The expandable bank of the present invention comprises generally a rigid body which may be molded, machined or otherwise worked into any desired configuration, for example, an animate configuration such as a popular piggy bank. The rigid body may be constructed of any suitable, non-yielding material, such as ceramic, glass, metal, hard plastic or the like. Integral legs are provided of the non-yielding material to elevate the body above a supporting surface. A portion of the body terminates downwardly in a bottom opening, which opening is supported above the supporting surface by the plurality of legs.

A flexible stretch material pouch removably secures to the rigid body at the bottom opening in a replaceable interconnection and is positioned to receive coins thereon as they are introduced into the interior of the bank through the coin slot. The flexible pouch is preferably fabricated of a stretch-type material such as special elasticized fabric or rubber which can stretch and distend in direct response to the weight of coins deposited thereon. As more and more coins are added, the flexible material of the pouch will stretch further and further until such time the bank is completely full. As the stretched pouch approaches the shelf or other support surface upon which the bank is positioned, the user will then know that it is time to empty the bank to thereby render the bank suitable for additional, continued use.

It is an important feature of this invention to secure the flexible pouch to the rigid body in the strong but releasable interconnection so that the bank can be emptied and then reused without any permanent damage to the structural elements. In a preferred embodiment, "VELCRO" hook and loop pile type fasteners are employed intermediate the bottom opening of the body and the periphery of the flexible stretch-type material. The "VELCRO" or other fastening means should be sufficiently strong so as to retain the rigid and non-rigid parts in association, even when the bank is completely full. By pulling or otherwise working the flexible pouch relative to the rigid body, the "VELCRO" or other type fasteners can be manually separated to facilitate emptying the coins from the bank. After removal of the coins, the pouch can be readily reapplied to the rigid body to again render the bank ready for use for receiving additional coins.

It is therefore an object of the present invention to provide an improved expandable bank of the type set forth.

It is another object of the present invention to provide a novel expandable bank comprising in combination a rigid body defining a bottom opening, a flexible pouch affixed to the rigid body and covering the bottom opening and releasable fastener means interconnecting the periphery of the flexible pouch to the rigid body to removably cover the bottom opening and render the bank suitable for receiving coins therein.

It is another object of the present invention to provide a novel, expandable bank comprising a rigid body of metallic, ceramic or hard plastic composition, the rigid body preferably being in the configuration of an animal such as a pig, the rigid body defining an enlarged bottom opening for removal of coins therethrough, a flexible pouch affixed to the rigid body about the bottom opening, the flexible pouch being adapted to flex or expand due to the weight of coins received on the flexible pouch and fastener means intermediate the periphery of the flexible pouch and the rigid body opening whereby the pouch may be securely affixed to the rigid body when the bank is in use and whereby the flexible pouch can be readily removed from association with the rigid body in order to facilitate the removal of coins from the bank through the bottom opening.

It is another object of the present invention to provide a novel, expandable bank that is inexpensive in manufacture, simple in design and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

BRIEF DESCRIPTION OF THE DRAWINGS

FIG. 3 is a cross sectional view similar to FIG. 2 showing the pouch of the expandable bank in a loaded or stretched condition.

FIGS. 4 and 5 are enlarged, partial, detailed views showing the interconnection between the flexible pouch and the rigid body.

DESCRIPTION OF THE PREFERRED EMBODIMENT OF THE INVENTION

Figure 1:
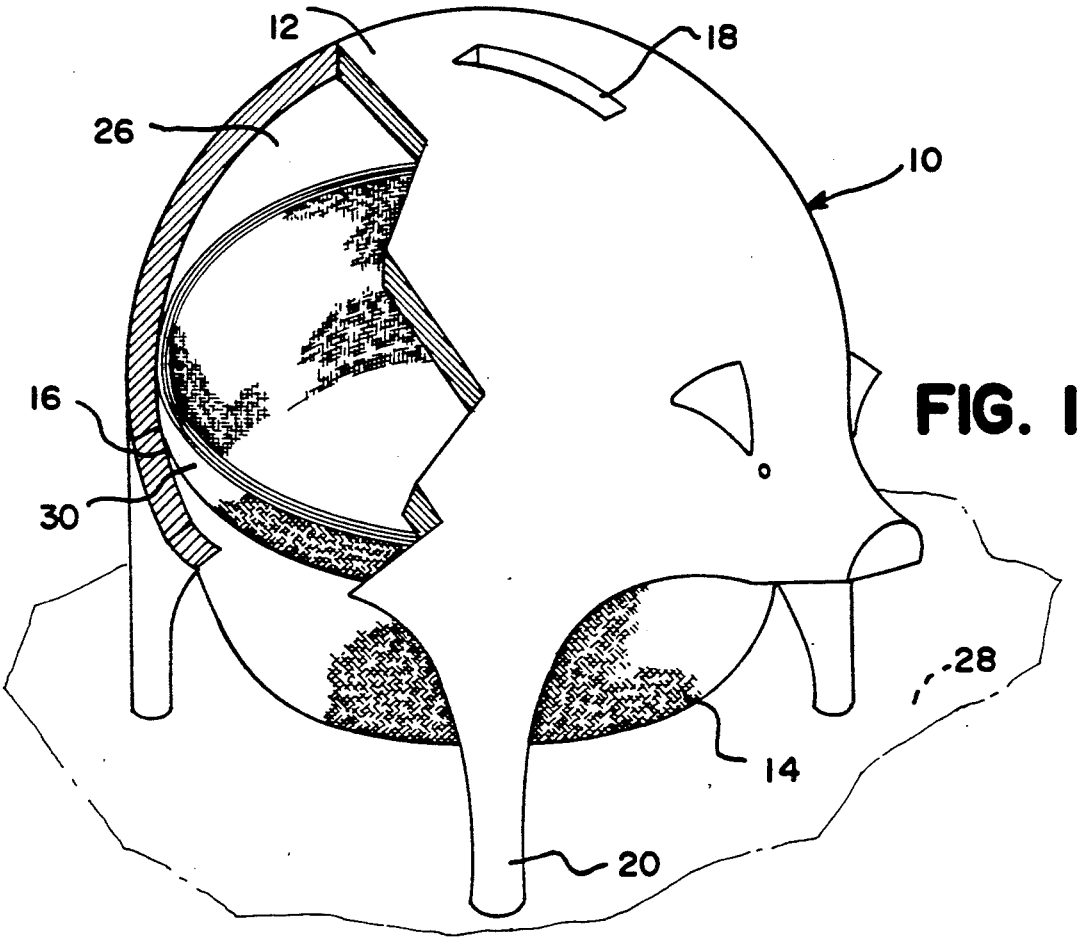
FIG. 1 is a perspective view showing the expandable bank of the present invention, partially broken away to expose interior construction features.

Although specific terms are used in the following description for the sake of clarity, these terms are intended to refer only to the particular structure of the invention selected for illustration in the drawings, and are not intended to define or limit the scope of the invention.

Referring now to the drawings, there is illustrated generally in FIG. 1 a toy, expandable bank 10 of the present invention which may be in the form of an animate or inanimate object. In the illustrated embodiment, the design of a stylized "piggy" bank configuration has been chosen. However, other designs and shapes may be employed with equal facility, and accordingly, the scope of the invention should not be limited or defined by any particular exterior appearance.

The bank 10 comprises generally a rigid body 12 which may fabricated of any suitable, formable, hard material, for example, metal, glass, ceramic, stoneware, hard plastic or the like. In the illustrated embodiment, the rigid body is preferably fabricated of unitary construction. However, should it prove necessary or desirable, the body can be fabricated of two or more sections which can be joined together utilizing well known connecting devices in known manner. An upper coin slot 18 penetrates entirely through the body 12 and is generally centrally positioned to conveniently receive coins (not shown) therethrough for coin storage and saving purposes in the usual manner.

Figure 2:
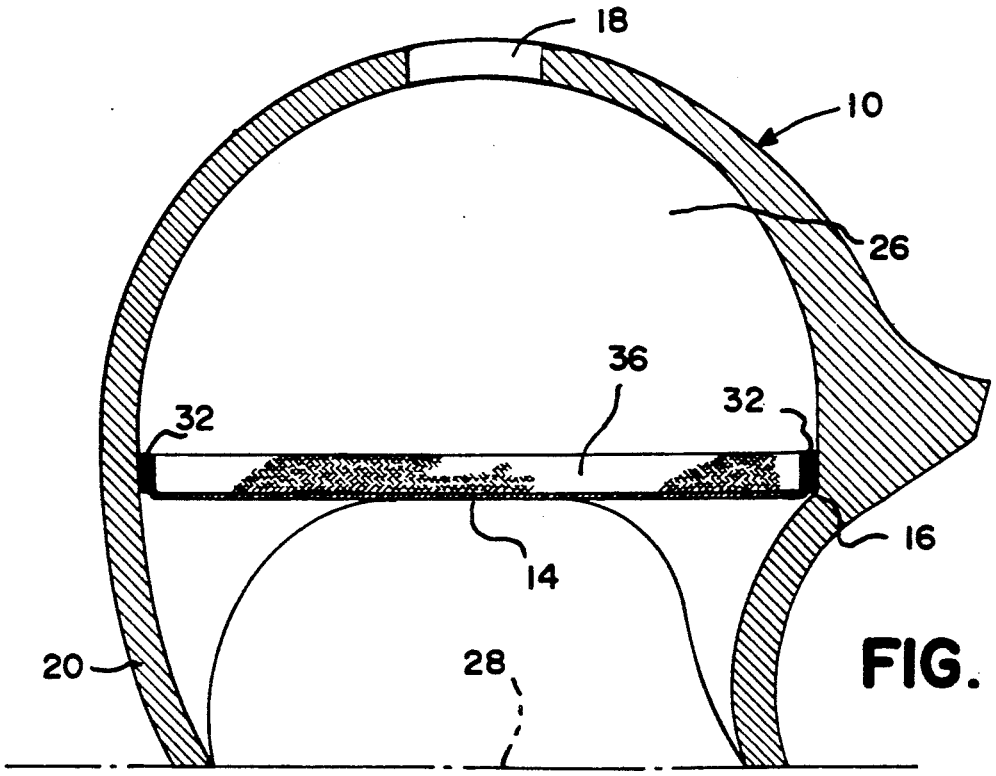
FIG. 2 is a cross sectional view of the expandable bank of FIG. 1, showing the pouch in an initial, unstretched condition.

As illustrated in FIGS. 2 and 3 and further considering FIG. 1, the rigid body 12 comprises a plurality of elevating legs 20 to define an elevated coin storage area above a support surface 28, such as a desk or shelf. Preferably, a plurality of four legs 20 are employed known manner to equally elevate and support the rigid body 12 above the table or desk top 28 in a stable manner. The rigid body 12 further comprises a central, bottom opening 16 which may be defined by a continuous, peripheral flange 30 to provide a connecting surface for the association and disassociation of a flexible material pouch or expander 14. As shown, the flexible material pouch or expander 14 is configured and is positioned to completely close the bottom opening 16 to thereby serve to retain coins within the interior of the bank 10.

It is intended that the flexible pouch or expander 14 should be firmly secured about the peripheral flange 30 so as not to be dislodged, separated or torn by the weight of coins as they are inserted into the interior 26 of the bank 10. Further, the interconnection between the pouch or expander 14 and the rigid body 12 should be releasable upon proper manipulation by the user so as to permit the bank to be emptied and reused whenever this becomes necessary. A fastener means 32 interacts between the peripheral edge 34 of the pouch or expander 14 and the peripheral flange 30 of the bottom opening 16 to releasably attach the flexible pouch or expander 14 to the rigid body 12. In as preferred embodiment, mating halves 22, 24 of a "VELCRO" type hook and loop pile fastener have been employed for this purpose. One "VELCRO" fastener half 22 can be cemented or otherwise secured to the peripheral flange 30 and the mating half 24 can be cemented or otherwise secured to the peripheral edge 34 of the flexible material pouch 14. Accordingly, when the mating "VELCRO" halves 22, 24 are brought together, the flexible material pouch 14 will be releasably secured to the rigid bank body 12 at the bottom opening 16 thereof.

When there are no or only a few coins (not shown) in the bank 10, the flexible pouch 14 will assume a substantially planar configuration 36 as illustrated in FIG. 2 whereby the user can readily determine that the bank is either empty or substantially empty. Upon the introduction of a number of coins into the interior 26 of the bank 10, the coins will drop through the coin slot 18 and will fall directly upon the flexible pouch 14 wherein the combined weight of the coins will cause the pouch material to expand to a stretched or expanded position 38 as best seen in FIG. 3.

When the expandable or flexible pouch 14 is so full as to stretch down to the support surface 28, the bank must then be emptied. This can be accomplished manually by simply pulling the peripheral edge 34 of the pouch material away from the peripheral flange 30 by utilizing sufficient force to break the mutual attraction of the "VELCRO" fastener halves 22, 24 to thereby separate the parts. Upon emptying the coins from the bank 10, the bank can be rendered suitable for continued use by simply reapplying the pouch material 14 over the bank opening 16 by applying the "VELCRO" fastener halves 22, 24 together.

Although the invention has been described with a certain degree of particularity, it is understood that the present disclosure has been made only by way of example and that numerous changes in the details of construction and the combination and arrangement of parts may be resorted to without departing from the spirit and scope of the invention. Thus, the scope of the invention should not be limited by the foregoing specification, but rather, only by the scope of the claims appended hereto.

What is claimed is:

1. An expandable bank for coins comprising a rigid, hollow body for receiving and storing coins therein, said rigid body being provided with an upper coin receiving slot and a lower opening, the lower opening being in vertical registry below the upper coin receiving slot;

a flexible material pouch removably covering the said lower opening and being adapted to receive coins directly thereon as the coins are inserted into the coin receiving slot and to expand in response to the weight of the coins; and fastener means releasably securing the flexible pouch to the rigid body about the said lower opening; whereby expansion of the flexible material pouch will give visual indication of the relative number of coins within the bank.

2. The expandable bank of claim 1 wherein the lower opening is defined by a peripheral flange, wherein the flexible material pouch is removably secured to the peripheral flange and wherein the peripheral flange is positioned in a substantially horizontal plane.

3. The expandable bank of claim 1 wherein the bank is positioned upon a support surface and wherein the rigid body comprises a plurality of spaced supports to elevate the lower opening above the support surface, the spaced supports defining an expansion space between the rigid body and the support surface.

4. The expandable bank of claim 3 wherein the flexible material pouch is movable from a first position when there are not coins within the bank to an expanded position when coins are stored within the bank.

5. The expandable bank of claim 4 wherein a portion of the flexible material pouch is positioned in the expansion space when the flexible material pouch is moved to its said expanded position.

6. An expandable bank for coins comprising a rigid, hollow body for receiving and storing coins therein, said rigid body being provided with an upper coin receiving slot and a lower opening, the lower opening being defined by a substantially horizontal planar edge;

a flexible material pouch removably covering the said lower opening, the pouch being adapted to receive coins thereon and to expand in response to the weight of the coins; and fastener means releasably securing the flexible pouch to the rigid body about the said planar edge which defined the lower opening, the fastener means comprising a hook and loop pile fastener having a pair of mating halves;

whereby expansion of the flexible material pouch will give visual indication of the relative number of coins within the bank.

7. The expandable bank of claim 6 wherein one of the mating halves is affixed to the horizontal planar edge which defines the lower opening in the body.

8. The expandable bank of claim 7 wherein the flexible pouch comprises an outer periphery and wherein the other mating half is affixed to the said outer periphery.

9. The method of using a coin storing bank of the type having a rigid, hollow body defining a bottom opening, a flexible material pouch having a periphery and being movably secured to the body and covering the opening and a plurality of supports elevating the body above a support surface and defining an expansion space between the rigid body and the support surface comprising affixing the flexible material pouch periphery to the hollow body at the bottom opening by employing hook and loop pile fasteners;

inserting a plurality of coins into the bank; receiving the coins on the flexible material pouch; expanding the pouch in response to the weight of the coins; and removing the pouch from the body by separating the hook and loop pile fasteners;

whereby coins stored within the bank can be retrieved.

10. The method of claim 9 wherein the expanding comprises stretching the pouch into the said expansion space and positioning the stretched pouch intermediate the plurality of supports.

* * * * *